United States Patent [19]

Kranberg et al.

[11] Patent Number: 4,731,803

[45] Date of Patent: Mar. 15, 1988

[54] CIRCUIT FOR OPERATING AN X-RAY TUBE

[75] Inventors: Heinz-Erik Kranberg, Erlangen; Horst Hallmann, Forchheim, both of Fed. Rep. of Germany

[73] Assignee: Siemens Aktiengesellschaft, Berlin and Munich, Fed. Rep. of Germany

[21] Appl. No.: 915,673

[22] Filed: Oct. 6, 1986

[30] Foreign Application Priority Data

Nov. 25, 1985 [DE] Fed. Rep. of Germany ..... 3541612

[51] Int. Cl.[4] ..... H05G 1/56

[52] U.S. Cl. ..... 378/114; 378/106; 378/117; 363/20

[58] Field of Search ..... 378/114, 117, 106; 363/20, 21

[56] References Cited

U.S. PATENT DOCUMENTS 4,191,891 3/1980 Amtmann et al. ..... 378/114

4,208,584 6/1980 Vogler et al. ..... 378/117

*Primary Examiner*—Craig E. Church

*Assistant Examiner*—John C. Freeman

[57] ABSTRACT

A circuit for operating an X-ray tube, such as in a medical diagnostics apparatus, is connected with a high-voltage generator and a switch mechanism for connecting and disconnecting the X-ray tube to the high-voltage generator. A resistor is disposed in a circuit branch which can be connected in parallel across the X-ray tube by a switch controlled by the aforementioned switch mechanism. If the X-ray tube is disconnected from the power source, the switch closes the circuit branch and causes the resistor to be connected across the X-ray tube. As a result, the X-ray tube voltage decreases relatively quickly after the high-voltage is disconnected. The resistor across the X-ray tube may be a variable resistor, such as a high-voltage triode.

5 Claims, 2 Drawing Figures

CIRCUIT FOR OPERATING AN X-RAY TUBE

BACKGROUND OF THE INVENTION

1. Field of the Invention

The present invention relates to an operating circuit for an X-ray tube for use with a high-voltage generator and a switch mechanism for connecting and disconnecting the X-ray tube to the high-voltage generator.

2. Description of the Prior Art

In X-ray diagnostics systems, a low power X-ray tube is used in certain operating modes, for example, in the transillumination mode and in a fluoroscopic pulsed mode. In these low power modes, X-ray tube currents or only a few milliamperes are used dependent on the X-ray tube voltage. As a consequence of the capacitances in the high-voltage circuit (high-voltage cable and smoothing capacitors in the high-voltage transformer), the X-ray tube voltage decays based on a small function of e, where e is the natural logarithm base, after the high-voltage is disconnected. The time constant of the decay depends on the size of the capacitance and on the internal resistance of the X-ray tube, i.e., on the adjusted X-ray tube current. The unavoidable presence or X-ray tube current, therefore, causes an additional radiation load on the patient in the form of a relatively large dose of low-energy radiation during the decay time of the X-ray tube voltage.

SUMMARY OF THE INVENTION

It is an object of the present invention to provide an operating circuit for an X-ray tube for use in a medical diagnostics system wherein the time constant with which the X-ray tube voltage decays arter the X-ray tube is disconnected from the high-voltage source is diminished in comparison to conventional systems.

The above object is achieved in accordance with the principles of the present invention by the use of a resistor disposed in a circuit branch which can be connected parallel to the X-ray tube. The resistor has a switch associated therewith controlled by the switch mechanism which connects and disconnects the X-ray tube to the high-voltage source. When the X-ray tube is disconnected from the high-voltage source, the switch associated with the resistor, completes the circuit branch across the X-ray tube, thereby placing the resistor in parallel with the X-ray tube. During the decay time, additional stray power is thus not unnecessarily generated, and only the energy stored in the capactances or the high-voltage circuit is dissipated in the resistor.

The circuit disclosed herein is particularly suited for use in the aforementioned transillumination and fluoroscopic pulsed modes, wherein the exposure technique of hard beam lung X-rays of up to 150 kV X-ray tube voltage with very short switching times is used. Without the circuit disclosed herein including the resistor, the charge in the cable capacitances given longer high-voltage cables can produce exposure fluctuations in the automatic exposure mode. These fluctuations distort the computer-controlled image constructed from a scan over the field of interest because such a scan is undertaken with a rapid sequence of extremely short individual exposures. Optimally, the exposures are made with a rectangular X-ray tube voltage pulse, so that any unwanted fluctuations cause a deviation from this optimum.

DESCRIPTION OF THE PREFERRED EMBODIMENTS

Figure 1:
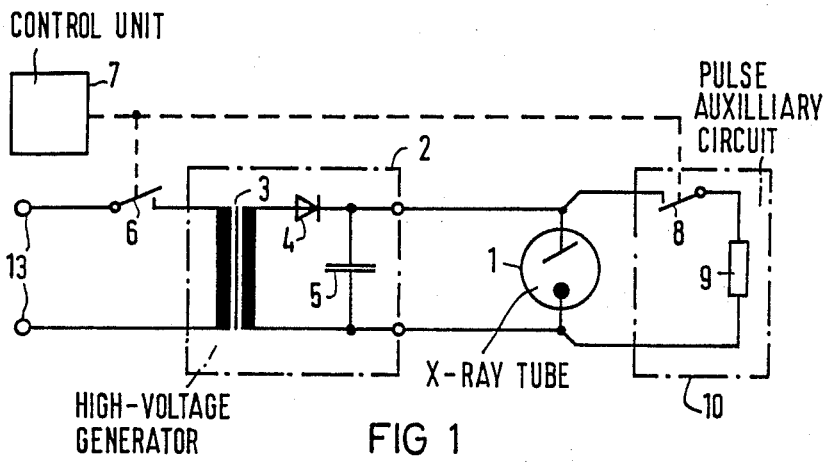
FIG. 1 is a schematic circuit diagram of an X-ray diagnostics system embodying a control circuit for the X-ray tube constructed in accordance with the principes of the present invention.

An X-ray diagnostics system is schematically shown in FIG. 1 which includes an X-ray tube 1 which is fed via a high-voltage generator 2 from a network connected at terminals 13. The high-voltage generator 2 contains a high-voltage transformer 3, a high-voltage rectifier 4 and a smoothing capacitor 5. Connection and disconnection of the high-voltage generator 2 to the network, and thus energizing and de-energizing the X-ray tube 1, is undertaken by a switch 6 connected in the primary circuit of the high-voltage transformer 3. The switch 6 is operated by a control unit 7.

The control unit 7 also operates a switch 8 which is connected in series with an ohmic high-voltage-proof resistor 9. The branch including the series connection of the switch 8 and the resistor 9 is connected in parallel with the X-ray tube 1.

When the supply of high voltage is interrupted by opening the switch 6, the switch 8 is closed by the control unit 7, so that the capacitances in the high-voltage circuit can quickly discharge via the resistor 9. The voltage across the X-ray tube 1 thererore decreases relatively quickly.

Figure 2:
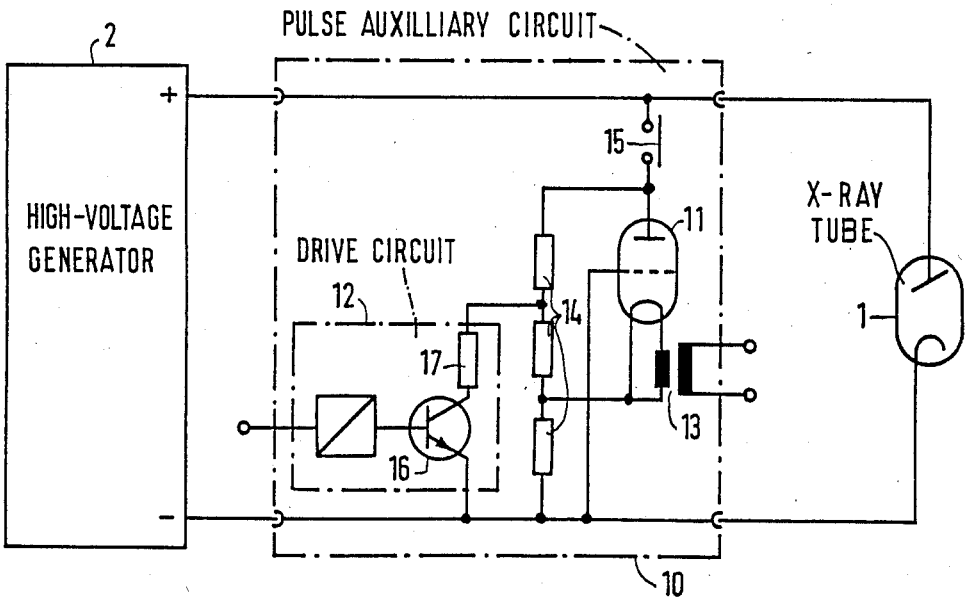
FIG. 2 is a schematic circuit diagram of a portion of the system shown in FIG. 1 showing further details of the X-ray tube operating circuit.

The resistor 9 can be combined with the switch 8 to form an integrable module and can be accomodated in an oil-filled vessel. A unit of this type is referred to below as a pulse auxiliary circuit. One embodiment shown in details of such a pulse auxiliary circuit 10 is shown in FIG. 2, the circuit 10 being connected between the X-ray tube 1 and the high-voltage generator 2. The pulse auxiliary circuit 10 incudes a high-voltage triode 11 which functions as a variable load resistor as well as a switch. The pulse auxiliary circuit 10 also includes a drive circuit 12 for the grid of the triode 11, a heating transformer 13 for heating the cathode of the triode 11 and for setting the resistance thereof via the anode current dependent on the filament current, and a voltage divider consisting of resistors 14 for generating the negative cut-off grid voltage for the triode 11. In the transillumination and fluoroscopic modes, for example, the pulse auxiliary circuit 10 can be switched into the system via an oil switch 15.

After the pulse auxiliary 10 is switched into the system and after the high-voltage has been connected to the X-ray tube 1, the X-ray tube voltage is across the anode-cathode path of the triode 11, and a negative cut-off voltage of about 3 kV is present at the grid thereof through the voltage divider consisting of resistors 14. The high-voltage triode 11 is thus inhibited. At the end of the pulse, the grid voltage is reduced to nearly zero volts, by the transistor 16 and the resistor 17 via the control device 7. At this point, the high-voltage triode 11 is driven and discharges the capacitances in the high-voltage circuit in a low-impedence manner. The X-ray tube voltage thus drops to values below 20 kV in about 0.5 ms.

The energy which is thus converted or dissipated in the high-voltage triode 11 amounts to only $0.5 \times C \times V^2 = 40$ Watt-Seconds given an X-ray tube voltage of 125 Kv and given an overall capacitance of $C \simeq 2.5 \times 10^{-9}$ F. in the high-voltage circuit.

The transistor 16 must be driven by a potential which is separated, however, because the transistor 16 is conducting only in the switched mode, the outlay remains low and a pulse transformer or opto-coupler, for example, may be used.

Although moditications and changes may be suggested by those skilled in the art it is the intention of the inventors to embody within the patent warranted hereon all changes and modifications as reasonably and properly come within the scope of their contribution to the art.

We claim as our invention:

1. In an X-ray diagnostics system including an X-ray tube, a high-voltage generator feeding said X-ray tube, a first switch for energizing and de-energizing said X-ray tube operated by a control unit, the improvement of a circuit for rapidly dissipating energy stored in components of said high voltage generator comprising:

a circuit branch having a resistance connected in series with a second switch, said circuit branch connected in parallel across said X-ray tube, said second switch also operated by said control unit and being normally open and being closed by said control unit simultaneously with said first switch being operated to de-energized said X-ray tube.

2. The improvement or claim 1, wherein said resistance is an ohmic high-voltage-proof resistor.

3. The improvement of claim 1, wherein said resistance is variable and further comprising means for varying said resistance dependent on the filament current of said X-ray tube.

4. The improvement or claim 1, wherein said resistance and said second switch are a high-voltage triode having a grid and further comprising drive means for operating said triode grid.

5. In an X-ray diagnostics system including an X-ray tube, a high-voltage generator feeding said X-ray tube, a first switch for energizing and de-energizing said X-ray tube operated by a control unit, the improvement comprising:

a high-voltage triode having a grid connected in parallel across said X-ray tube;

a drive circuit for operating the grid of said triode including a voltage divider connected across said triode and a transistor having a control electrode connected to said control device for switching said triode to a conducting state simultaneously with said control unit operating said first switch to de-energize said X-ray tube, so as to dissipate energy through said triode stored in components of said high voltage generator.

* * * * *